US012305955B2

(12) United States Patent
Parsons et al.

(10) Patent No.: US 12,305,955 B2
(45) **Date of Patent: *May 20, 2025**

(54) EXTENDABLE BATON WITH DAMAGE RESISTANT LOCKING MECHANISM

(71) Applicant: ARMAMENT SYSTEMS AND PROCEDURES, INC., Appleton, WI (US)

(72) Inventors: Kevin Parsons, Appleton, WI (US); Siu Ngai Wang, Hong Kong (CN)

(73) Assignee: Armament Systems and Procedures, Inc., Appleton, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/098,222

(22) Filed: Jan. 18, 2023

(65) Prior Publication Data

US 2023/0152055 A1 May 18, 2023

Related U.S. Application Data

(63) Continuation of application No. 16/635,492, filed as application No. PCT/US2019/051242 on Sep. 16, 2019, now Pat. No. 11,585,630.

(Continued)

(51) Int. Cl.
*F41B 15/02* (2006.01)

(52) U.S. Cl.
CPC ..... *F41B 15/027* (2013.01)

(58) Field of Classification Search
CPC ..... F41B 15/027
See application file for complete search history.

(56) References Cited

U.S. PATENT DOCUMENTS 5,372,363 A 12/1994 Siddle
6,231,447 B1 * 5/2001 Pelkey ..... F41B 15/027 403/368

(Continued)

FOREIGN PATENT DOCUMENTS

CN 104964603 A 10/2015
CN 207247990 U 4/2018

(Continued)

OTHER PUBLICATIONS

International Search Report of PCT/US2019/051242 dated Oct. 24, 2019, 3 pages.

(Continued)

*Primary Examiner* — William M Pierce
(74) *Attorney, Agent, or Firm* — Hahn Loeser & Parks LLP

(57) ABSTRACT

An extendable baton has a base section, at least one extendable section and a control rod. The base section may be tubular and have a lengthwise axis and an annular recess on an inner surface of a distal end and a release button on a proximal end. The extendable section may be tubular and nest inside the base section. The extendable section includes a locking clutch including a single slot disposed on the proximate end, a clutch plate disposed at least partially within the slot, the clutch plate including a locking portion, which engages the annular recess and a control aperture portion having an aperture, and at least one spring disposed to bias the clutch plate outwardly from the slot of the extendable section. The control rod is insertable through the aperture to retract the clutch plate when the release button is depressed.

15 Claims, 5 Drawing Sheets

Related U.S. Application Data

(60) Provisional application No. 62/732,745, filed on Sep. 18, 2018.

(56) References Cited

U.S. PATENT DOCUMENTS

| | | | | |
|---|---|---|---|---|
| 8,721,459 | B2 * | 5/2014 | Pelkey | F41B 15/027 463/47.7 |
| 9,677,843 | B2 * | 6/2017 | Parsons | F41B 15/027 |
| 9,677,844 | B2 | 6/2017 | Pelkey | |
| 9,719,753 | B2 * | 8/2017 | Parsons | F41B 15/027 |
| 11,067,359 | B1 * | 7/2021 | Chiang | F41B 15/027 |
| 11,243,046 | B2 * | 2/2022 | Chen | F16B 7/105 |
| 11,585,630 | B2 * | 2/2023 | Parsons | F41B 15/027 |
| 2007/0087844 | A1 * | 4/2007 | Labes | F41B 15/027 463/47.7 |
| 2013/0150167 | A1 * | 6/2013 | Pelkey | F41B 15/027 463/47.7 |
| 2014/0194212 | A1 * | 7/2014 | Walter | F41B 15/027 463/47.7 |
| 2014/0256452 | A1 * | 9/2014 | Cheng | F41B 15/027 463/47.7 |
| 2015/0038240 | A1 * | 2/2015 | Parsons | F41B 15/027 463/47.7 |
| 2016/0169616 | A1 * | 6/2016 | Cheng | F41B 15/00 463/47.7 |
| 2021/0199402 | A1 * | 7/2021 | Parsons | F41B 15/027 |

FOREIGN PATENT DOCUMENTS

| | | | |
|---|---|---|---|
| EP | 2604966 | B1 | 9/2016 |
| JP | 2010002149 | A | 1/2010 |

OTHER PUBLICATIONS

Written Opinion of the International Searching Authority of PCT/US2019/051242 dated Oct. 24, 2019, 6 pages.

Apr. 12, 2023 Office Action mailed in Taiwanese Patent Application No. 108133607, 26 pages.

* cited by examiner

EXTENDABLE BATON WITH DAMAGE RESISTANT LOCKING MECHANISM

FIELD OF THE INVENTION

The field of the invention relates to telescopically extending and locking batons. More particularly, the field of the invention relates to extendable and lockable/releasable police or military batons with improved durability and reliability.

BACKGROUND

Batons for use by the police and military are well known. Such batons can be of great value in close quarters or where non-lethal force is necessary or warranted. In many cases, batons used by the police or military are compact to carry and easy to deploy. Such batons may be constructed of one or more telescoping sections including a handle and more or more sections that slide into the handle.

A three-section telescoping baton with locking clutches and a button release is disclosed, for example, in U.S. Pat. No. 9,677,843, which is incorporated by reference. These batons are advantageous because they may be deployed to an extended and locked position and unlocked and stowed with one hand. Referring to FIG. 5, in such designs, an inner baton section 1 includes a locking clutch comprising two opposing semi-circular clutch plates 3 that fit into slots which have been cut into opposing sides of one end of the inner baton section 1. When collapsed, the clutch plates are kept retracted by clutch alignment rod. As each inner baton section is extended, the clutch alignment rod is withdrawn from the clutch plates, which are then biased outward by springs. When the baton section is fully extended, the clutch plates extend outwardly from the slots and into recesses in the next outer section to lock the two sections together. To collapse an extended and locked baton, a user pushes a button which extends the clutch alignment rod through apertures in the clutch plate coaxially with the baton section, which thereby aligns the clutch plates and withdraws them from the recess of the next outer baton section, allowing the baton to be collapsed while pushing on the ends of the baton.

While very convenient to deploy and stow, there are some disadvantages with such locking clutch designs. The ends of the baton sections where the locking clutches are located may be weakened by the slots for the clutch plates. Referring to FIG. 6, after cutting the slots 5, the remaining section portions 7 are relatively thin. Also, the clutch plates nest against each other where the alignment rod goes through, requiring those annular portions 9 of the locking plates to be at half thickness relative to the semi-circular portions, creating another potential area of weakness. Such weak spots may result in failure. When a baton is used to strike an object, forces from the most extended section of the baton may be propagated through one or more intermediate extended sections to the handle. Due to the forces, the extended sections may deflect within the next larger section. When this happens, the relatively thin section portions 7 and/or annular portions 9 of the locking plates 3 may fail, breaking the locking clutch. Accordingly, a need exists for more durable extendable extended sections.

Another issue with known designs is that elastomeric O-rings are used to reduce play between sections. Such elastomeric O-rings must be treated with oil or other lubricant to provide a low friction interface. However, the oil or lubricant may attract dirt and contamination, or be wiped off the mating surfaces completely. If left unserviced, the oil or lubricant may dry up, seizing the baton sections against each other, rendering the baton inoperable, to the detriment of the user.

SUMMARY

An extendable baton is provided, having a base section, at least one extendable section and a control rod connected to a release button. The base section may be tubular and have a lengthwise axis, a first annular recess on an inner surface of a distal end and a release button on a proximal end, the first annular recess having a width. The extendable section may also be tubular and be dimensioned to nest inside the base section coaxially with the longitudinal axis. The extendable section includes a locking clutch on a proximate end, the locking clutch including a single slot disposed on the proximate end of the extendable section, a clutch plate disposed at least partially within the slot, the clutch plate including a locking portion having an arc that fits within the slot and a thickness that fits within the width of the first annular recess, and a control aperture portion having a control aperture, a guide cap disposed on the proximate end of the extendable section including a guide aperture, and at least one spring disposed to bias the clutch plate outwardly from the slot of the extendable section. The control rod is insertable through the guide and control apertures to retract the clutch plate toward the slot of the extendable section when the release button is depressed. When the extendable section is extended from the base section, the control rod is withdrawn from the aperture, the spring biases the clutch plate outwardly from the slot of the extendable section, and the locking portion of the clutch plate engages the annular recess.

It has been found that reducing the number of semi-circular clutch plates from two to one provides several advantages relating to the durability of the baton and to the cost the of manufacture, while still providing sufficient locking performance. The single slot section end has better resistance to damage from shock loading. The base section may comprise a handle of the baton.

The extendable baton may have a plurality of extendable sections having locking clutches. For example, the at least one extendable section may comprise a first extendable section having a second annular recess on an inner surface of a distal end of the first extendable section, and the extendable baton may further comprise a second extendable section. The second extendable section may be a smaller version of the first extendable section and may be tubular and dimensioned to nest inside the first extendable section coaxially with the longitudinal axis. The second extendable section also includes a second locking clutch on a proximate end, the second locking clutch being controlled by the same control rod and being dimensioned to engage the second annular recess when the second extendable section is extended.

The clutch plate disposed at least partially within the slot may consist of a single clutch plate. The locking portion of the clutch plate may have a radius that substantially matches the proximal end of the extendable section. The aperture may be located at a center of the radius. The control aperture portion of the clutch plate may have a thickness that is substantially the same as the locking portion of the clutch plate.

The slot may have an arc which is less than half the circumference of the proximal end of the extendable section.

When the control rod is inserted through the aperture to retract the clutch plate, the clutch plate may be retracted completely within the slot.

The extendable baton may further include a plastic ring disposed in the distal end of the base section to provide a low friction bearing surface for the extendable section.

In one example, the guide cap is formed from a high impact thermoplastic and at least one spring seat is a molded into the guide cap. In another example, the guide cap is formed from metal for additional impact damage resistance. In another example, a portion of the section end opposite the clutch plate is reinforced for additional impact damage resistance.

In one particular example, an extendable baton is provided. The extendable baton has a handle section, first and second extendable sections and a control rod connected to a release button. The handle section may be tubular and have a lengthwise axis, a first annular recess on an inner surface of a distal end and a release button on a proximal end, the first annular recess having a width. The first extendable section may also be tubular and be dimensioned to nest inside the handle section coaxially with the longitudinal axis. The first extendable section includes a first locking clutch on a proximate end and a second annular recess on a distal end, the first locking clutch including a single slot disposed on the proximate end of the first extendable section, a clutch plate disposed at least partially within the slot, the clutch plate including a locking portion having an arc that fits within the slot and a thickness that fits within the width of the first annular recess, and a control aperture portion having a control aperture, a first guide cap disposed on the proximate end of the first extendable section including a guide aperture, and at least one spring disposed to bias the clutch plate outwardly from the slot of the extendable section. The second extendable section may also be tubular and be dimensioned to nest inside the first extendable section coaxially with the longitudinal axis. The second extendable section includes a second locking clutch on a proximate end, the second locking clutch including a single slot disposed on the proximate end of the first extendable section, a clutch plate disposed at least partially within the slot, the clutch plate including a locking portion having an arc that fits within the slot and a thickness that fits within the width of the second annular recess, and a control aperture portion having a control aperture, a second guide cap disposed on the proximate end of the second extendable section including a guide aperture, and at least one spring disposed to bias the clutch plate outwardly from the slot of the extendable section.

The control rod is insertable through the guide apertures and control apertures to retract the clutch plates toward their respective slots of the extendable sections when the release button is depressed. When the extendable sections are extended from the handle section, the control rod is withdrawn from the apertures, the springs bias the clutch plates outwardly from the slots of the extendable sections, and the locking portions of the clutch plates engage their respective annular recesses. This may happen sequentially or simultaneously.

In one example, the first guide cap is formed from a high impact thermoplastic and at least one spring seat is a molded into the guide cap, the second guide cap is formed from metal, and in the second extendable section, a portion of the section end opposite the clutch plate is reinforced for additional impact damage resistance.

DETAILED DESCRIPTION OF AN ILLUSTRATED EMBODIMENT

Figure 1B:
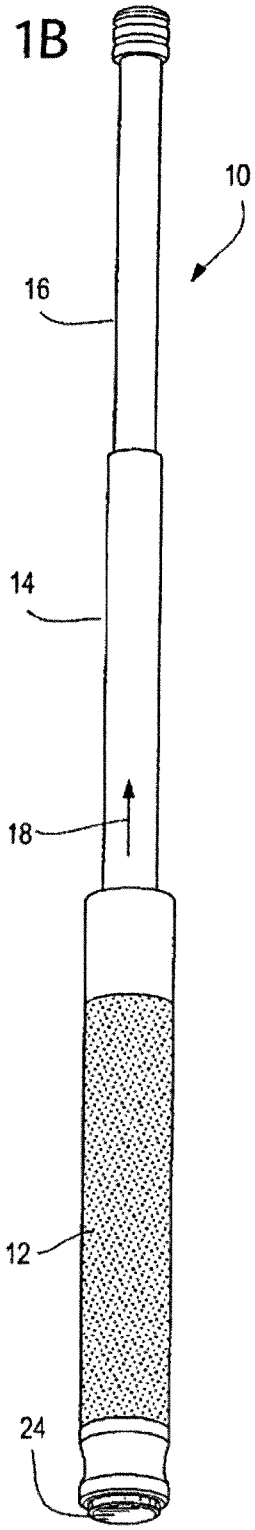
FIGS. 1A-B illustrates an example of an extendable baton in both stowed and deployed positions.

While embodiments can take many different forms, specific embodiments thereof are shown in the drawings and will be described herein in detail with the understanding that the present disclosure is to be considered as an exemplification of the principles hereof, as well as the best mode of practicing same. No limitation to the specific embodiment illustrated is intended.

Figure 1A:
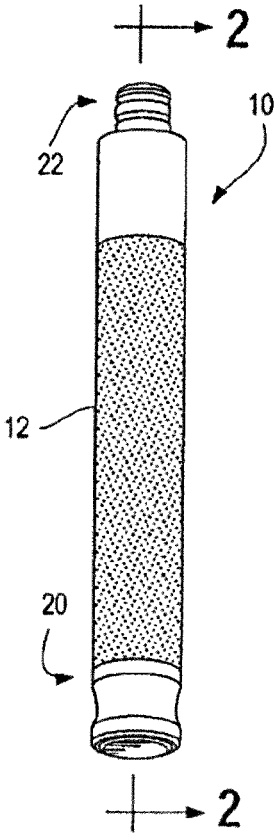

FIGS. 1A-B is a side view of a police or military baton 10 shown generally in accordance with an illustrated embodiment. FIG. 1A shows the baton 10 in a retracted or stowed position and FIG. 1B shows the baton 10 in an extended position ready for use against an adversary.

In general, the baton is constructed of one or more tubular sections. The outermost section may comprise a base section, such as a handle section 12. In a stowed position (FIG. 1A), the inner section 16 and intermediate section 14 are coaxial and nested within the handle section 12, and may partly extend from a distal end of handle section 12 and any intermediate sections. A baton tip 16*a* may be threaded on to a distal end of inner section 16. As used herein, proximate and distal are used with respect to a user holding the baton ready for use.

In a deployed state (FIG. 1B), the inner sections 14, 16 remain in a coaxial relationship with the handle section 12 and are extended along the predominant axis 18 of the sections 12, 14, 16. The baton 10 may be deployed conventionally by grasping the handle section 12 with the heel of the user's hand near a proximate end 20 and flicking the distal end 22 with the baton tip 16*a* outwards away from the user via a quick rotation of the user's wrist.

Once deployed, a respective spring-loaded locking clutch (discussed below) locks each extended section 14, 16 to the directly adjacent next larger section. In this regard, the locking clutch locks the inner section 16 to the intermediate section 14 (or to the handle section 12 if no intermediate section is used).

The baton 10 may include a release button 24 on the proximate end of the handle section 12. The release button 24 operates a control rod 34. The control rod 34 extends between the release button 24 and each of the locking clutches. As the baton 10 is deployed and each section locks to the next section, the release button 24 may pop out of the handle section 12 as the control rod is disengaged from the locking clutches. To stow the baton, a user simply activates the button (pushing it back into the handle) to cause the control rod 34 to retract the locking clutches and then pushes the inner section 16 (and any intermediate sections) back into the handle section 12 thereby returning the baton 10 to the stowed position or state.

Figure 2:
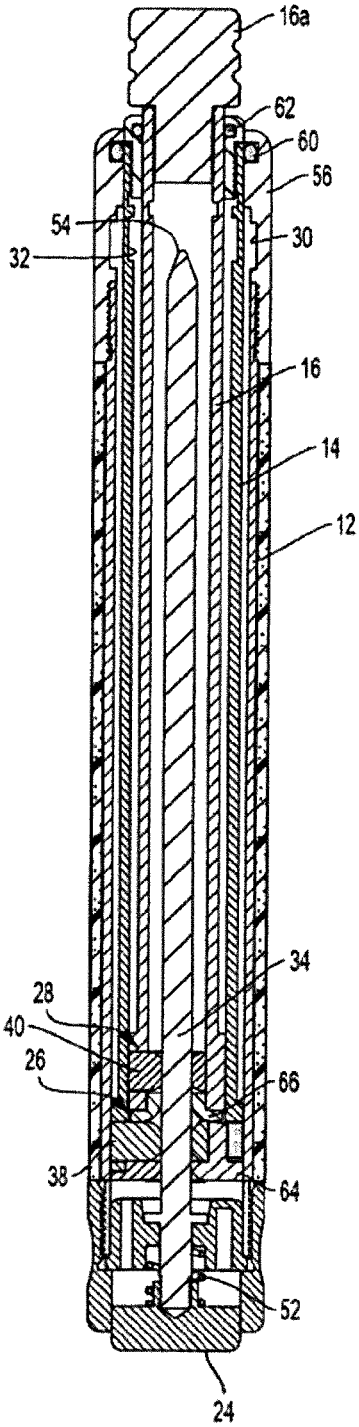
FIG. 2 shows a cut-away view of a baton having an improved locking clutch according to the present invention.

FIG. 2 is a cut-away view of the baton 10. As shown in FIG. 2, the intermediate section 14 and inner section 16 each include a respective locking clutch 26, 28. As the sections of the baton are extended to the fully deployed position, the locking clutches 26, 28 each engage and lock into a respective recess 30, 32. In the illustrated example, recess 32 is an annulus cut into the inner surface of the distal end of intermediate section 14, and recess 30 is an annulus cut into a collar 56 that is threaded onto handle section 12. Each recess may be more deeply cut than in opposing clutch plate designs.

Figure 3:
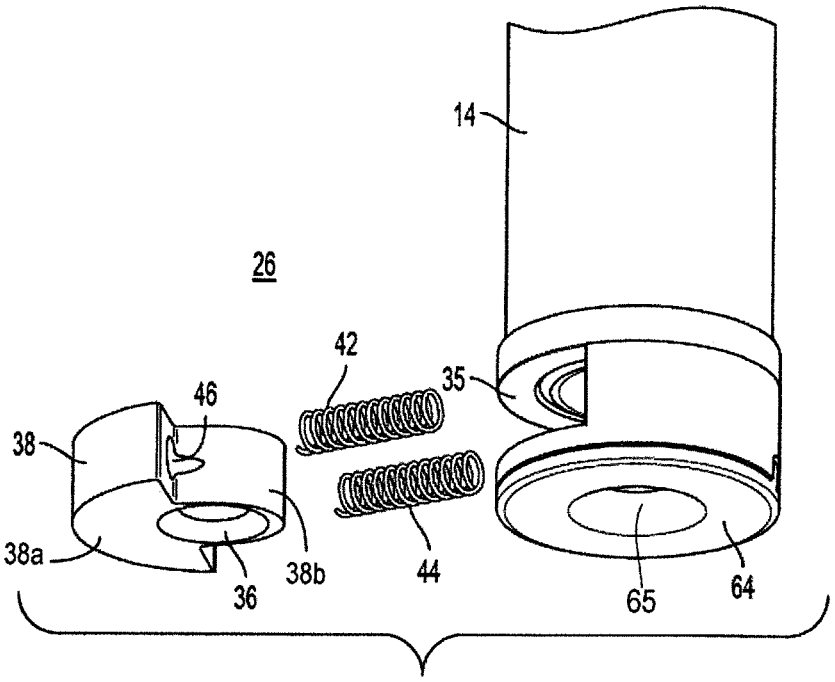
FIG. 3 is an exploded view of a locking clutch according to one aspect of the present invention.
Figure 4A:
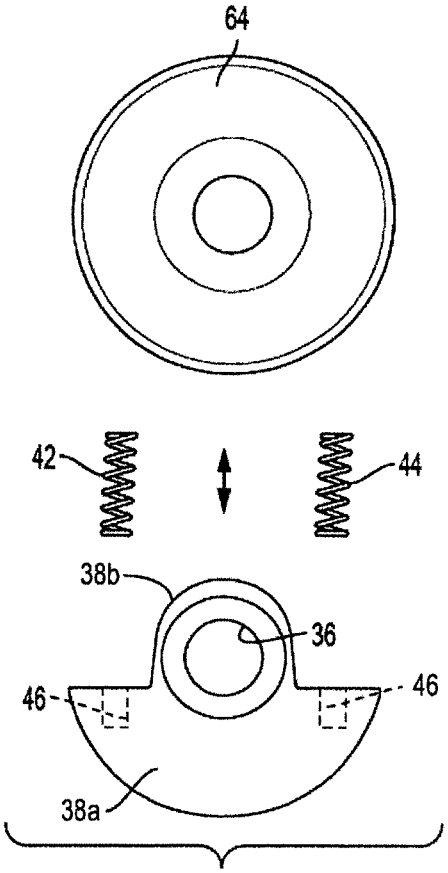
FIGS. 4A, 4B, and 4C show components of a locking clutch of the embodiment in FIG. 3.
Figure 4B:
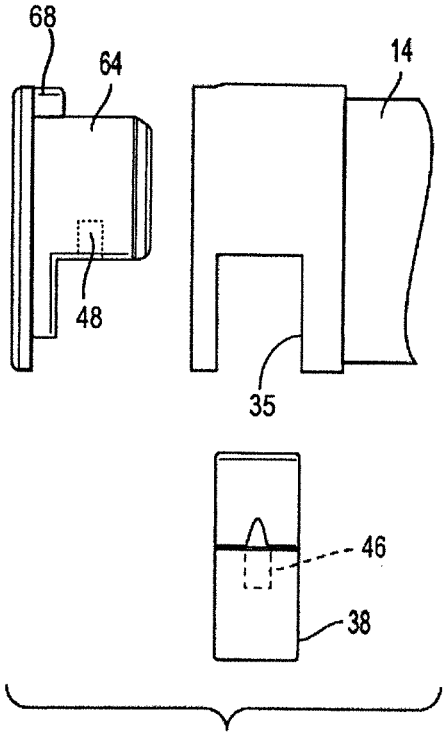

FIG. 3 is an exploded view of the distal end of the intermediate section 14 showing components of the locking clutch 26. FIGS. 4A and 4B are exploded views of locking clutch 26 components including a top view and a side view. With reference to these figures, a locking clutch may comprise a slot 35, semicircular clutch plate 38, and springs 42, 44. In the illustrated example, a single slot and clutch plate is included for each locking clutch. The slot 35 has an arc of just less than half the circumference of section end on which it is situated. However, the slot 35 may be larger than illustrated, including larger than half the circumference of the section end, so long as sufficient strength is maintained in the section end to avoid breakage.

The clutch plate 38 may include a locking portion 38*a* and a control aperture portion 38*b*. The locking portion may comprise an outer edge defined by an arc (partial circumference of a circle) and a radius that is substantially the same as the distal end of intermediate section 14. The length of the arc is such that the clutch plate substantially matches the slot 35. The control aperture portion may have an aperture 36 at a center of the radius of the arc. The control aperture portion may be the same or substantially the same thickness as the locking portion. While the term "semicircular" may be used to describe the shape of clutch plate 38, the arc need not comprise an exact half circle. The arc of a clutch plate may be less than half a circumference of the section end in which it is located.

The single slot 35 is cut into the distal end of the intermediate section 14 to receive a single clutch plate 38 of the locking clutch 26. Once inserted into the slot 35, an aperture 36 may be engaged by the control rod 34 to secure the clutch plate 38 within the slot 35.

Also, because only one slot 35 is provided, a side of the section 14, 16 opposite slot 35 may be reinforced to provide even more resistance against damage from shock loading.

Figure 4C:
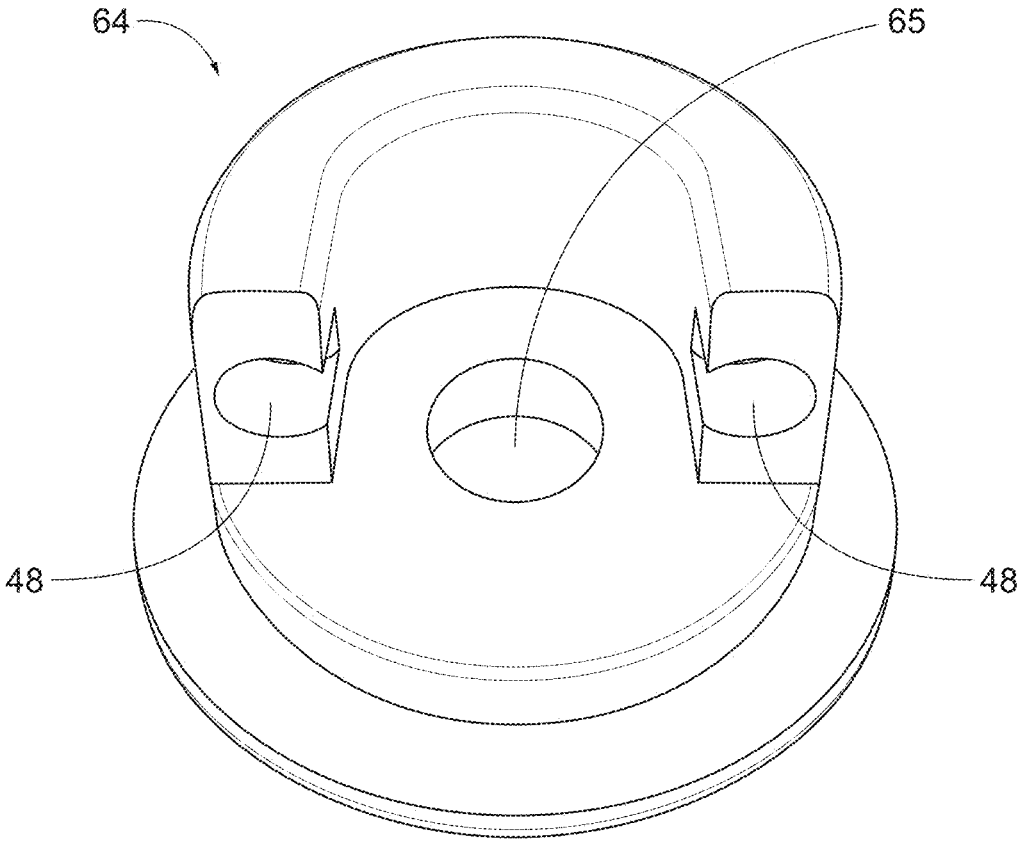

In the illustrated example, the locking clutch 26 further comprises a guide cap 64. As further illustrated by FIG. 4C, the guide cap 64 may be formed from a thermoplastic, such as polyoxymethylene (sold under the brand name Delrin). In some embodiments, the thermoplastic comprises high impact polypropylene for additional impact damage resistance. Guide cap 64 includes an aperture 65 to guide the control rod 34 and recessed seats 48 for springs 42, 44. The guide cap 64 provides the advantages of reducing machining required for spring seats and improving the retraction action of the baton by guiding the control rod to the aperture of the clutch plate. In some embodiments, the guide cap 64 is retained in place by the springs 42,44, and clutch plate 38. In other embodiments, the guide cap is held in place by adhesive or a friction fit.

Included within the clutch plate 38 are a set of spring seats 46 that receive the other ends of the springs 42, 44. Because there is only one clutch plate 38, the control aperture portion of clutch plate 38 may be made at the full thickness of the locking portion of the clutch plate which engages the recess 30, thereby improving resistance to damage from shock loading.

The inner section 16 has a similar single slot and locking clutch 28, including clutch plate 40 and guide cap 66 sized appropriately to a diameter of inner section 16 and recess 32. The configuration and operation of the components of locking clutch 28 may be the same as or similar to locking clutch 26, and for purposes of brevity are not separately illustrated in exploded view.

Figure 5:
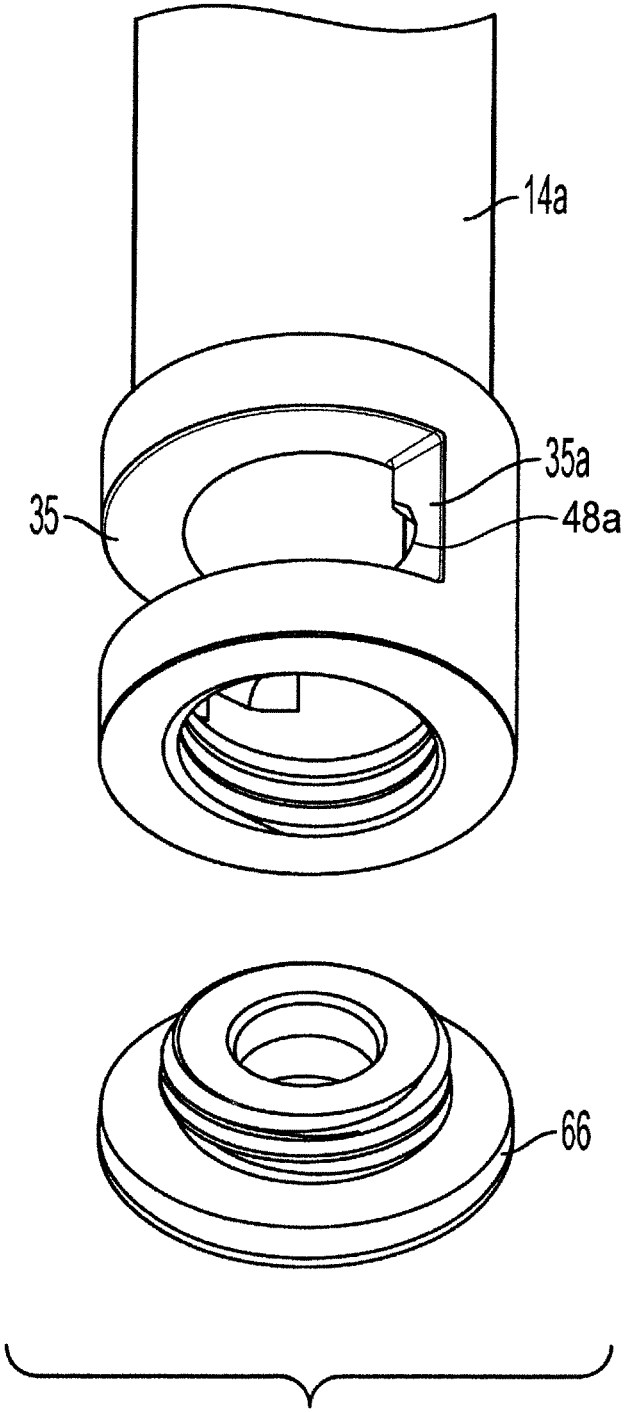
FIG. 5 illustrates a section end and guide cap according to another aspect of the invention.
Figure 6:
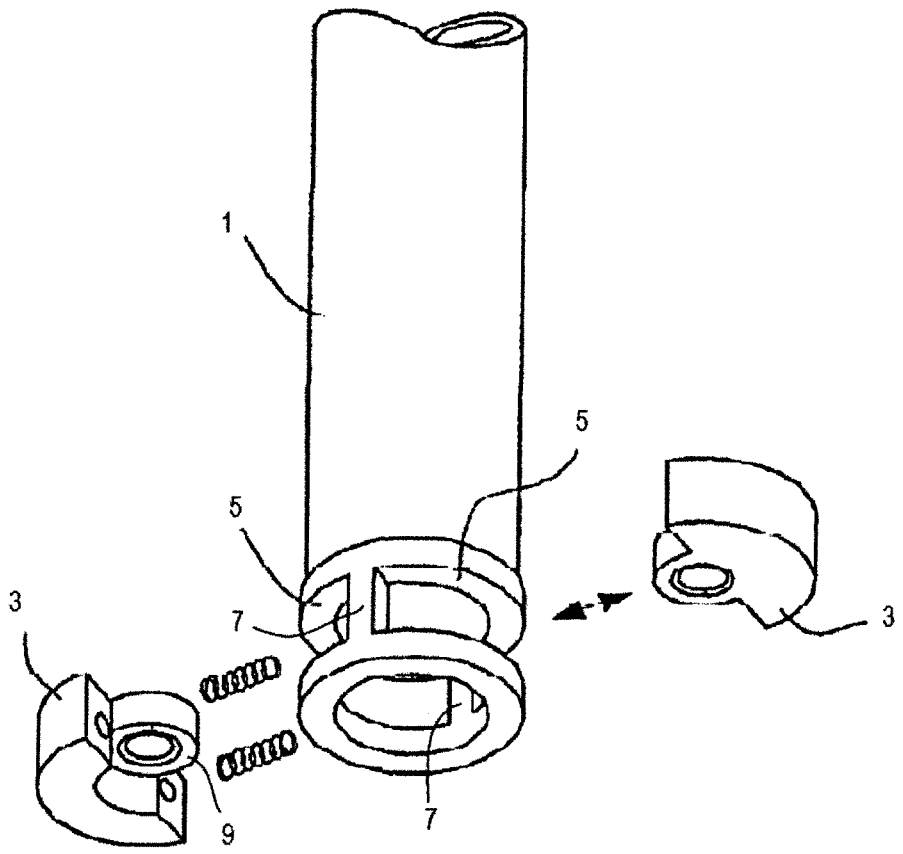
Fig. 6 (Prior Art)
FIG. 6 is an exploded view of prior art locking clutch components.

In some embodiments, as illustrated in FIG. 5, the portion 35*a* of the section end 14*a* opposite a clutch plate is reinforced against impact damage with metal and seats for springs drilled into the section end. For example, in some embodiments, one or both of the guide caps 64, 66 may comprise a metal component attached to the proximal end of a baton section. The metal may comprise, for example, stainless steel. Examples of attaching the metal guide cap included threaded engagement, epoxy attachment, friction (interference) fit, and a combination of threaded engagement with epoxy or a thread-locking compound. In one embodiment, epoxy is applied to a top surface of the section end and/or inside surface of the guide cap and the components assembled together.

In some embodiments, a combination of metal and thermoplastic guide caps are used within the same baton. For example, guide cap 66 on inner section 16 may be fabricated as a metal component, and guide cap 64 on intermediate section 14 may be fabricated as a thermoplastic component. Such an arrangement optimizes strength at the striking end of the baton and reduced cost in the middle of the baton.

Compression rings 60, 62 (FIG. 2) may be included in the handle section 12 and intermediate section 14. Compression rings 60, 62 may be formed of a thermoplastic, such as acetal (polyoxymethylene) or other high-impact polymer. A split is provided in the compression rings to allow for expansion/compression during installation and compression/expansion when fit on a groove or annular recess on a section end. Compression ring 60 fits into an annular recess on the distal end of handle 12 and reduces play between intermediate section 14 and handle section 12, while providing a low-friction bearing surface for intermediate section 14 to extend from handle section 12. The low-friction surface is achieved without requiring oil or other lubricant as are required with prior known elastomeric O-rings, which may attract dirt and/or require periodic replacement. Compression ring 62 likewise reduces play between inner section 16 and intermediate section 14 while providing a low friction bearing surface. While low friction compression rings 60, 62 are considered advantageous, the locking clutches 26, 28 of the present invention may also be used in combination with elastomeric O-rings to reduce play.

During use, the control rod 34 extends through apertures 36 thereby holding the apertures 36 in coaxial alignment with the baton sections 14, 16. The springs 42, 44 of each locking clutch 26, 28 are held in compression. So long as the control rod 34 extends through the apertures 36, an outer edge of the locking clutch 26, 28 is held even with (or slightly within) an outer circumference (outside annular edge) of the respective sections 14, 16. When the control rod 34 is withdrawn from the apertures, the springs bias the clutch plates 38, 40 outwards towards an inner surface of the next outer section, and eventually into the recesses 30, 32 when fully extended, thereby locking each inside section of the baton to the next closest outer section that is directly adjacent the inside section. In some embodiments, the surface of control rod 34 is textured or knurled. This provides a degree of control over a level of friction between the control rod 34 and the apertures 36 of the clutch plates 38, 40 to avoid inadvertent deployment. This may be advantageously combined with the low friction compression rings 60, 62 to achieve a baton that deploys reliably with reduced maintenance, yet does not inadvertently deploy if held tip down.

As the clutch plates 38, 40 move radially outwards, the apertures 36 are no longer in axial alignment with the sections 14, 16. However, even with the clutch plates 38, 40 extended, the predominant axis 18 of the baton sections still passes through the apertures 36, albeit off center. This allows a tapered end 54 of the control rod 34 to later re-engage and retract the clutch plates 38, 40.

In order to deploy the baton 10, a user may grasp the handle section 12 on one end and the baton tip 16*a* on the distal end of the inner section 16 and pull outwards. The outwards force may first cause the inner section 16 to begin sliding outwards relative to the intermediate section 14 and handle section 12. Since the control rod 34 is attached to the handle section 12, the outward movement of the inner section 16 causes the control rod 34 to begin to withdraw from the aperture 36 of the locking clutch 28. Immediately before the locking clutch 28 reaches the recess 32, the control rod 34 exits the aperture 36 of the locking clutch 28. This allows the springs to push the semicircular plate 38 outwards into the recess 32, thereby locking the first end of the inner section 16 to the second end of the intermediate section 14.

If the user continues to pull, the inner section 16, locked to intermediate section 14, causes the intermediate section 14 to begin moving outwards away from the handle section 12. As the intermediate section 14 moves outwards, the control rod 34 begins to withdraw from the locking clutch 26 of the intermediate section 14. Immediately before the locking clutch 26 reaches the recess 30, the control rod 34 exits the aperture 36 of the retainer of the intermediate section. This allows the springs of the locking clutch 26 to push the semicircular plates into the recess 30, thereby, locking the intermediate section to the handle section 12.

As the intermediate section locks to the handle section 12, the release button 24 may pop out of the end of the handle section 12. In one example, as the control rod 34 exits the locking clutches, a control rod 34 spring 52 (FIG. 2) pushes the button 24 outwards at the same instant as the baton locks in the fully deployed state. In another example, the button is biased outward by the spring 52 even when the baton 10 is in a stowed configuration, and does not pop further out when the baton 10 is deployed.

In order to stow the baton 10, the user may first depress or otherwise activate the release button and then push the baton tip 16*a* towards the handle section 12. Depressing the release button 24 causes the control rod 34 to re-enter and align the aperture 36 of the locking clutch 26, thereby retracting the locking clutch plate 38 from recess 30. More specifically, a tapered distal end of the control rod 34 enters the aperture 36 contacting the aperture along one edge. As the tapered end enters the aperture, the sliding contact on the taper pushes the aperture into alignment by forcing the semicircular clutch plate inwards thereby realigning the aperture 36 with the control rod 34 and predominant axis 18 of the sections 14, 16 thereby retracting the clutch plates 38 and releasing the locking clutch 26. This allows the intermediate section 14 to be nested within handle section 12. As intermediate section 14 is fully retracted, if the user continues to depress button 24, the tapered end of the control rod 34 with push into alignment clutch plate 40 of locking clutch 28, retracting clutch plate 40 from recess 32. This allows the inner section 16 to be nested within intermediate section 14.

The locking clutches of the present invention offer significant advantages over prior batons. For example, the section ends incorporating the locking clutches are stronger than opposing locking plate designs due to only one slot 35 being cut into the section end. The portion of the section end opposite slot 35 may also be reinforced for additional strength and damage resistance. Additionally, the individual locking clutch plates 26, 28 are stronger than dual opposing locking plate designs because the full thickness of the plate may be maintained throughout the entire locking clutch plate. Thus, reliability and resistance to failure during use in the field is greatly improved. Additional benefits of the present invention include reduced cost of manufacture because there are fewer components to make or purchase, and reduced labor for assembly.

From the foregoing, it will be observed that numerous variations and modifications may be effected without departing from the spirit and scope hereof. It is to be understood that no limitation with respect to the specific apparatus illustrated herein is intended or should be inferred. It is, of course, intended to cover by the appended claims all such modifications as fall within the scope of the claims.

What is claimed is:

1. An extendable baton, comprising;

a base section, the base section being tubular and having a lengthwise axis, a first annular recess on an inner surface of a distal end and a release button on a proximal end, the first annular recess having a width;

at least one extendable section, the extendable section being tubular and dimensioned to nest inside the base section coaxially with the longitudinal axis, the extendable section comprising a locking clutch on a proximate end, the locking clutch comprising:

one single slot disposed on the proximate end of the extendable section;

a clutch plate inserted through and disposed at least partially within the slot, the clutch plate including a locking portion having an arc that fits within the slot and a thickness that fits within the width of the first annular recess, and a control aperture portion;

a guide cap inserted into and disposed on the proximate end of the extendable section including a guide aperture, the clutch plate seated within the guide cap through the one single slot wherein a distal end of the guide cap terminates at a distal end of the clutch plate;

at least one spring disposed to bias between the guide cap and the clutch plate forcing the clutch plate outwardly from the slot of the extendable section; and a control rod connected to the release button, the control rod being insertable through the guide aperture and the control aperture to retract the clutch plate toward the slot of the extendable section when the release button is depressed.

2. The extendable baton according to claim 1, wherein the at least one extendable section comprises a first extendable section having a second annular recess on an inner surface of a distal end of the first extendable section, the first extendable section comprising the locking clutch, the extendable baton further comprising a second extendable section, the second extendable section being tubular and dimensioned to nest inside the first extendable section coaxially with the longitudinal axis, the second extendable section comprising a second locking clutch on a proximate end of the second extendable section, the second locking clutch being controlled by the control rod and being dimensioned to engage the second annular recess when the second extendable section is extended.

3. The extendable baton according to claim 1, wherein the base section further comprises a handle section.

4. The extendable baton according to claim 1, wherein the locking portion of the clutch plate has an outer radius that substantially matches an outer radius of the proximate end of the extendable section.

5. The extendable baton according to claim 1, wherein the control aperture portion of the clutch plate has a thickness substantially the same as the locking portion of the clutch plate.

6. The extendable baton according to claim 1, wherein the base section further comprises a tubular section and a collar threaded onto the tubular section, and wherein the first annular recess is formed in the collar.

7. The extendable baton according to claim 1, further comprising an impact resistant plastic compression or expansion ring disposed in the distal end of the base section.

8. The extendable baton according to claim 1, wherein the guide cap is formed from a high impact thermoplastic and includes at least one spring seat.

9. An extendable baton, comprising:

a handle section being tubular and having a lengthwise axis and comprising a first annular recess and a second annular recess, the first and second annular recesses being disposed on an inner surface of a distal end of the handle section, and a release button on a proximal end of the handle section;

an impact resistant polymer ring disposed in the second annular recess of the handle section;

at least one extendable section, a first extendable section of the at least one extendable section being tubular and dimensioned to nest inside the handle section coaxially with the lengthwise axis, the first extendable section comprising a retractable locking clutch plate on a proximal end of the first extendable section, the retractable locking clutch plate inserted through and disposed at least partially within a slot, the slot disposed on the proximal end of the first extendable section, the retractable locking clutch plate seated within a guide cap through the slot wherein a distal end of the guide cap terminates at a distal end of the clutch plate, the retractable locking clutch plate comprising a control aperture secured between the guide cap and the first extendable section and operably connected to the guide cap; and a control rod connected to the release button, the control rod being insertable through the control aperture to retract the retractable locking clutch plate toward the first extendable section when the release button is depressed.

10. The extendable baton according to claim 9, wherein the control rod is textured to control a level of friction between the control rod and the control aperture of the retractable locking clutch plate.

11. The extendable baton according to claim 9, further comprising a second extendable section, the second extendable section being tubular, having a lengthwise axis, and dimensioned to nest inside the first extendable section coaxially with the lengthwise axis of the second extendable section, the second extendable section comprising a retractable locking clutch plate on a proximal end of the second extendable section, the retractable locking clutch plate of the second extendable section inserted through and disposed at least partially within a slot, the slot disposed on the proximal end of the second extendable section, the retractable locking clutch plate of the second extendable section is maintained within the slot of the second extendable section by at least one spring biasing between the retractable locking clutch plate of the second extendable section and a sidewall of the second extendable section and is secured from movement in a direction along the lengthwise axis by the slot, the retractable locking clutch plate of the second extendable section comprising a control aperture; and the control rod being insertable through the control aperture of the retractable locking clutch plate of the second extendable section to retract the retractable locking clutch plate of the second extendable section toward the second extendable section when the release button is depressed.

12. An extendable baton, comprising:

a handle section being tubular and having a lengthwise axis;

a release button on a proximal end of the handle section;

a first extendable section, the first extendable section being tubular and dimensioned to nest inside the handle section coaxially with the lengthwise axis, the first extendable section comprising a retractable locking clutch plate on a proximal end of the first extendable section;

a second extendable section, the second extendable section being tubular, having a lengthwise axis, and dimensioned to nest inside the first extendable section coaxially with the lengthwise axis of the second extendable section, the second extendable section comprising a retractable locking clutch plate on a proximal end of the second extendable section, the retractable locking clutch plate of the second extendable section inserted through and disposed at least partially within a slot, the slot disposed on the proximal end of the second extendable section, the retractable locking clutch plate of the second extendable section is maintained within the slot by at least one spring biasing between the retractable locking clutch plate of the second extendable section and a sidewall of the second extendable section and is secured from movement in a direction along the lengthwise axis by the slot, the retractable locking clutch plate of the second extendable section comprising a control aperture; and a control rod connected to the release button, the control rod being insertable through the control aperture of the retractable locking clutch plate of the second extendable section to retract the retractable locking clutch plate of the second extendable section toward the second extendable section when the release button is depressed.

13. The extendable baton according to claim 12, wherein the control rod is textured to control a level of friction between the control rod and the control aperture of the retractable locking clutch plate of the second extendable section.

14. The extendable baton according to claim 12, wherein the handle section further comprises a first annular recess and a second annular recess, the first and second annular recesses of the handle section being disposed on an inner surface of a distal end of the handle section;

an impact resistant polymer ring disposed in the second annular recess of the handle section;

the first retractable locking clutch plate of the first extendable section inserted through and disposed at least partially within a slot, the slot disposed on the proximal end of the first extendable section, the retractable locking clutch plate of the first extendable section seated within a guide cap through the slot of the first extendable section wherein a distal end of the guide cap terminates at a distal end of the clutch plate, the retractable locking clutch plate of the first extendable section comprising a control aperture secured between the guide cap and the first extendable section and operably connected to the guide cap; and the control rod being insertable through the control aperture of the retractable locking clutch plate of the first extendable section to retract the retractable locking clutch plate of the first extendable section toward the first extendable section when the release button is depressed.

15. The extendable baton according to claim 14, wherein when the first extendable section is extended from the handle section, the control rod is withdrawn from the control aperture of the retractable locking clutch plate of the first extendable section, the retractable locking clutch plate of the first extendable section engages a first annular recess of the handle section; and wherein when the second extendable section is extended from the first extendable section, the control rod is withdrawn from the control aperture of the retractable locking clutch plate of the second extendable section, the retractable locking clutch plate of the second extendable section engages a first annular recess of the first extendable section, the first annular recess of the first extendable section being disposed on an inner surface of a distal end of the first extendable section.

* * * * *